US011224881B2

(12) United States Patent
Hirose et al.

(10) Patent No.: US 11,224,881 B2
(45) Date of Patent: Jan. 18, 2022

(54) GRINDING ROLLER AND MILL

(71) Applicant: MITSUBISHI HITACHI POWER SYSTEMS, LTD., Kanagawa (JP)

(72) Inventors: Yuichi Hirose, Tokyo (JP); Yoshimichi Tominaga, Tokyo (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 796 days.

(21) Appl. No.: 15/554,561

(22) PCT Filed: Aug. 31, 2015

(86) PCT No.: PCT/JP2015/074635

§ 371 (c)(1),
(2) Date: Aug. 30, 2017

(87) PCT Pub. No.: WO2016/139830

PCT Pub. Date: Sep. 9, 2016

(65) Prior Publication Data

US 2018/0071745 A1 Mar. 15, 2018

(30) Foreign Application Priority Data

Mar. 5, 2015 (JP) ..... JP2015-043497

(51) Int. Cl.
*B02C 15/00* (2006.01)
*B02C 15/04* (2006.01)

(52) U.S. Cl.
CPC ..... *B02C 15/005* (2013.01); *B02C 15/04* (2013.01); *B02C 2015/002* (2013.01)

(58) Field of Classification Search
CPC ... B02C 15/004; B02C 15/005; B02C 15/007; B02C 15/04; B02C 15/10; B02C 2015/002; B21B 27/02
(Continued)

(56) References Cited

U.S. PATENT DOCUMENTS 4,232,834 A 11/1980 Player et al.
4,717,082 A 1/1988 Guido et al.
(Continued)

FOREIGN PATENT DOCUMENTS

EP 2 468 408 6/2012
JP 62-126255 8/1987
(Continued)

OTHER PUBLICATIONS

Office Action dated Sep. 11, 2019 in Indian Patent Application No. 201717029606, with English-language translation.
(Continued)

*Primary Examiner* — Edward T Tolan
*Assistant Examiner* — Katie L. Parr
(74) *Attorney, Agent, or Firm* — Wenderoth, Lind & Ponack, L.L.P.

(57) ABSTRACT

A grinding roller is configured so that the fatigue strength of a roller housing can be ensured, and product life can thus be ensured. The grinding roller includes: a roller housing; a roller main body; a pressing plate; a tab hole; and a tab. A line at which fastening stress caused by the pressing plate is concentrated on a base portion of a fixing stopper part of the roller housing and a line at which stress caused by a grinding load received by the roller main body is concentrated on a base portion of the tab hole of the roller housing are disposed in an offset manner so as not to intersect each other.

12 Claims, 5 Drawing Sheets

(58) Field of Classification Search
USPC ..... 492/16, 28, 57, 58, 59
See application file for complete search history.

(56) References Cited

U.S. PATENT DOCUMENTS

| | | | | |
|---|---|---|---|---|
| 5,114,082 | A | 5/1992 | Brundiek | |
| 5,513,812 | A | 5/1996 | Brundiek | |
| 2006/0273209 | A1* | 12/2006 | Parham ..... | B02C 15/04 241/121 |

FOREIGN PATENT DOCUMENTS

| | | |
|---|---|---|
| JP | 63-25149 | 2/1988 |
| JP | 3-115044 | 11/1991 |
| JP | 07-053710 | 12/1995 |

OTHER PUBLICATIONS

International Search Report of the International Searching Authority dated Nov. 17, 2015 in International Application No. PCT/JP2015/074635.
Written Opinion of the International Searching Authority dated Nov. 17, 2015 in International Application No. PCT/JP2015/074635.
Office Action dated Mar. 26, 2019 against the Chinese Patent Application No. 201580077141.6, with English translation.
Extended European Search Report dated Dec. 21, 2017, in European Patent Application No. 15883996.9.
Office Action dated Jan. 9, 2018 in Japanese Patent Application No. 2015-043497, with English translation.
Office Action dated Jul. 5, 2018 in corresponding Chinese Patent Application No. 201580077141.6, with English translation.

* cited by examiner

FIG. 1A
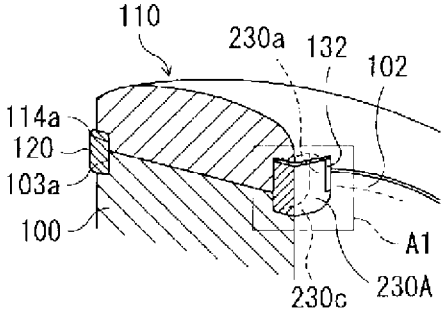
FIG. 1B
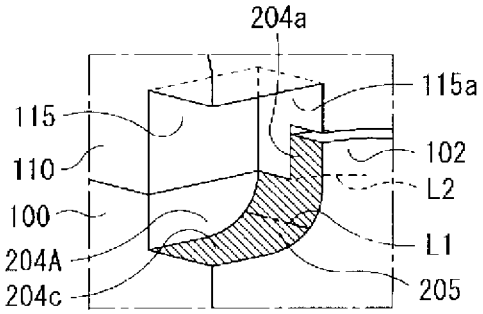
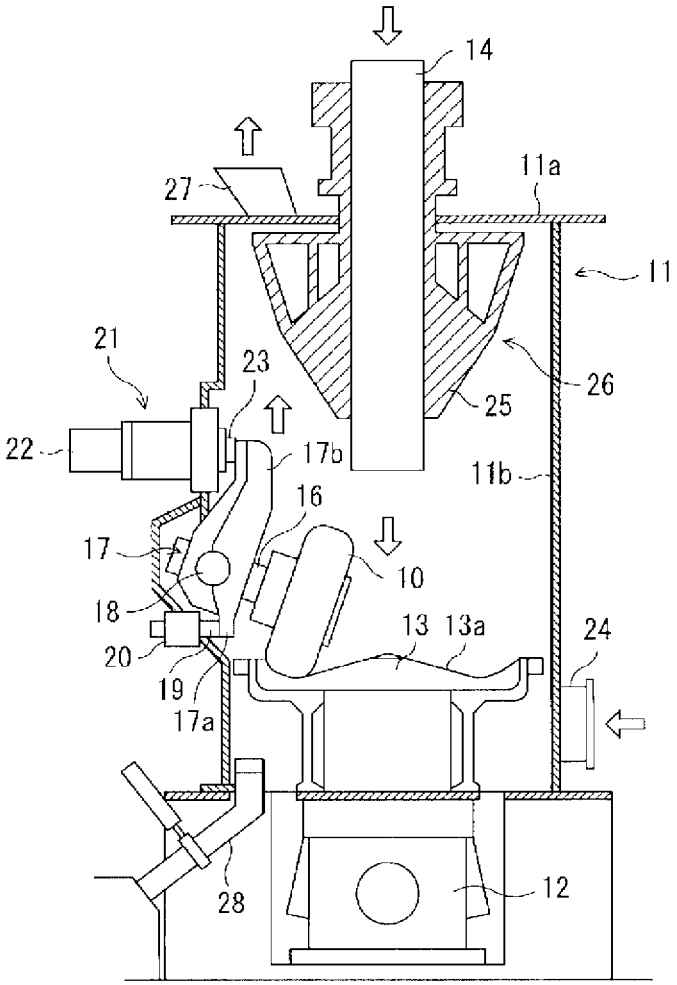
FIG. 2

FIG. 6A PRIOR ART
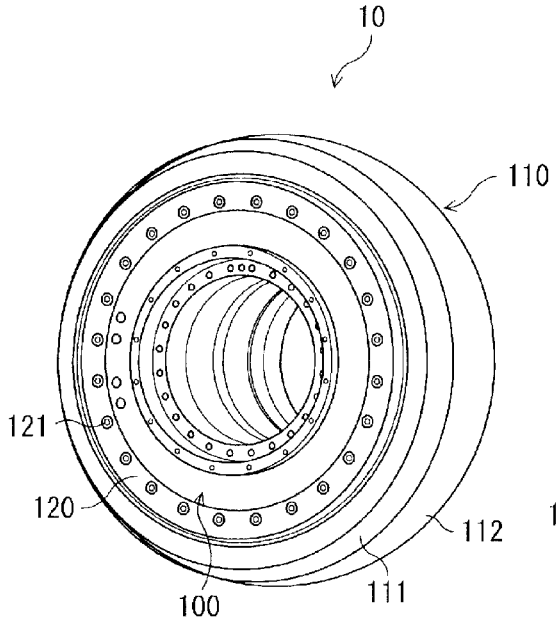
FIG. 6B PRIOR ART
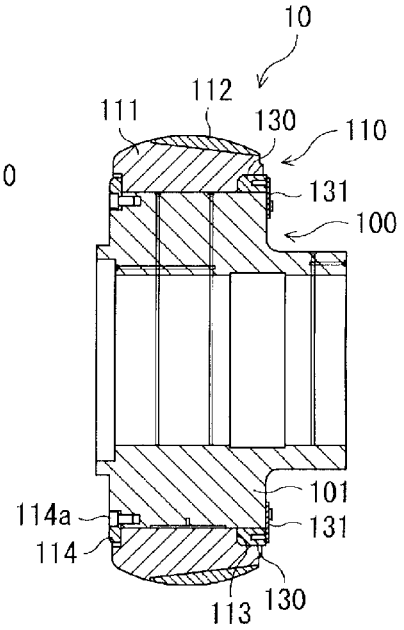
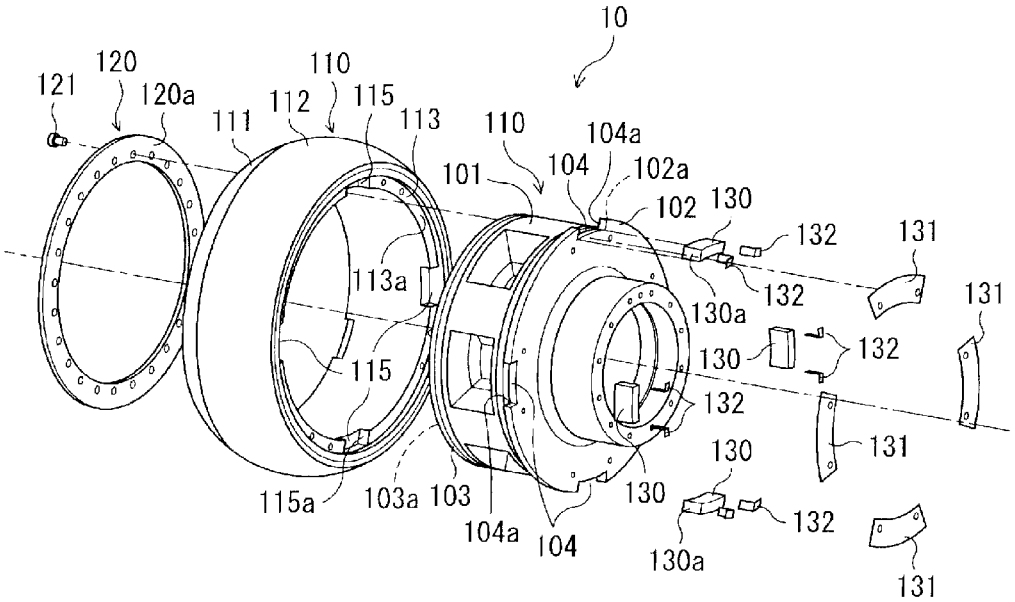
FIG. 7 PRIOR ART FIG. 10A
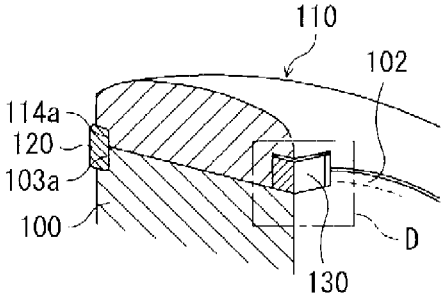
FIG. 10B
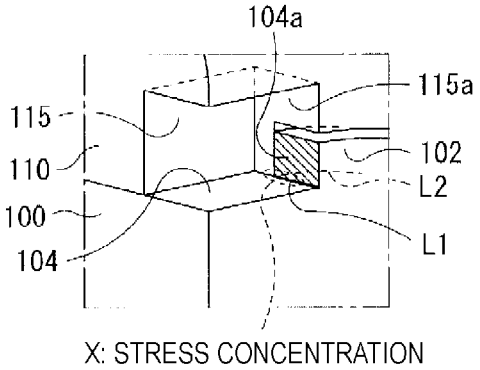
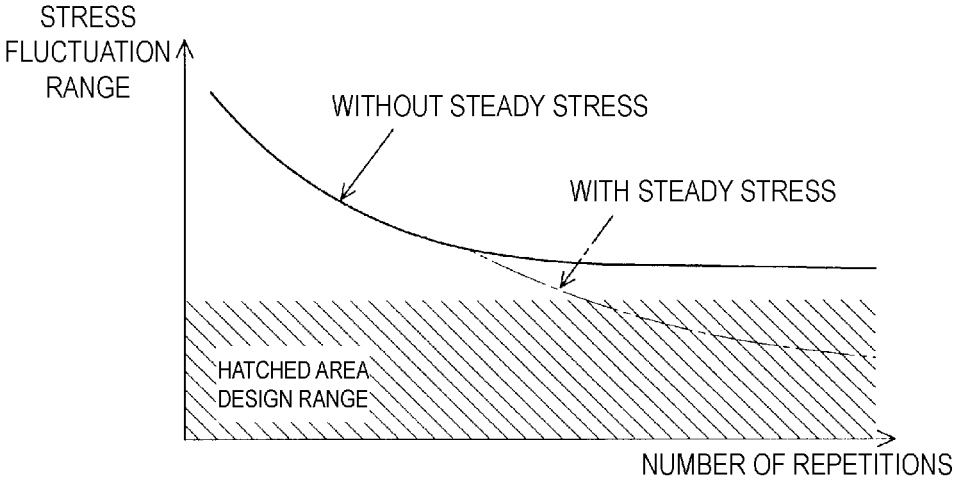
FIG. 11

GRINDING ROLLER AND MILL

TECHNICAL FIELD

The present invention relates to a grinding roller that grinds and pulverizes a solid matter such as coal, and to a mill provided with the grinding roller.

BACKGROUND ART

Conventionally, a pulverized coal combustion device is known, such as a thermal power generation boiler, which is fueled by pulverized coal obtained as a result of grinding coal into a powder form using a coal grinder (a mill). The coal grinder grinds raw coal supplied from a coal feeder using a grinding roller and a grinding table (manufactures pulverized coal), and transports the pulverized coal to a boiler side with the help of a flow of primary air (see Patent Document 1).

As illustrated in FIGS. 6A, 6B and 7, a grinding roller 10 of such a coal grinder includes a roller housing (hereinafter, also simply referred to as "housing") 100 and a roller main body (hereinafter, also simply referred to as "roller") 110 that is externally fitted to the housing 100 in a detachable manner. The roller 110, which is a main component of the coal grinder, is subject to wear during operation. Thus, a configuration is employed in which the roller 110 is fitted into the housing 100, and only the roller 110 is replaced in accordance with the wear amount.

The housing 100 is formed in a tubular shape, and a roller supporter (hereinafter, also simply referred to as "supporter") 101, which has an enlarged diameter, is formed on the outer circumference of the housing 100. A support shaft (not illustrated) is fitted into the inner circumference of the housing 100, and the roller 110 is fitted onto the outer circumference of the supporter 101 of the housing 100. The roller 110 is formed in an annular shape, and has a holder portion 111 fixed to the housing 100 on the inner circumferential side thereof. A grinding pressure contact portion 112, which presses against and grinds the coal to be ground, is fixedly provided on the outer circumference of the holder portion 111.

The roller 110 is fixed as a result of the holder portion 111 being externally fitted onto the housing 100, which causes the roller 110 to be fixed in the rotational direction as well as in the axial direction. The roller 110 is sandwiched, from both ends in the axial direction thereof, between a flange-shaped fixing stopper part (hereinafter, also simply referred to as "stopper part") 102 formed in the housing 100 and a pressing plate 120 joined to the housing 100, which causes the roller 110 to be fixed in the axial direction. Tabs 130 are fixed into tab holes formed in both the housing 100 and the roller 110, which causes the roller 110 to be fixed in the rotational direction.

The fixing in the axial direction will now be explained. The stopper part 102 is formed protruding on the outer circumference of one end of the supporter 101 of the housing 100, and a ring-shaped groove 113, which fits with the stopper part 102, is formed on the inner circumference of the one end of the roller 110. Further, a ring-shaped groove 103, onto which the pressing plate 120 is mounted, is formed on the outer circumference of the other end of the supporter 101 of the housing 100, and a ring-shaped groove 114, onto which the pressing plate 120 is mounted, is formed on the inner circumference of the other end of the roller 110.

Pressure contact surfaces 102*a* and 113*a*, which face and press against each other, are respectively formed on the stopper part 102 of the housing 100 and the ring-shaped groove 113 of the roller 110, and pressure contact surfaces 103*a* and 114*a*, which face and press against the pressing plate 120, are respectively formed on the ring-shaped groove 103 of the housing 100 and the ring-shaped groove 114 of the roller 110.

The pressing plate 120 is a plate member formed in an annular shape. The pressing plate 120 is mounted onto the ring-shaped groove 103 provided on the other end of the housing 100 and onto the ring-shaped groove 114 provided on the other end of the roller 110, and is fastened to the housing 100 by multiple bolts 121 with the roller 110 fitted on the outer circumference of the supporter 101 of the housing 100.

As a result of this fastening, a pressure contact surface 120*a* of the pressing plate 120, which faces the pressure contact surface 103*a* of the housing 100 and the pressure contact surface 114*a* of the roller 110, is pressed against the pressure contact surface 103*a* of the housing 100, and at the same time, is pressed with a greater pressing force against the pressure contact surface 114*a* of the roller 110. Additionally, as a result of this fastening, the pressure contact surface 102*a* of the stopper part 102 of the housing 100 is pressed against the pressure contact surface 113*a* of the ring-shaped groove 113 of the roller 110. This configuration causes the roller 110 to be fixed to the housing 100 in the axial direction.

The fixing in the rotational direction will now be explained. A plurality of tab holes (tab fitting grooves) 104 are formed, in the outer circumference of the one end of the supporter 101 of the housing 100, like notches in the stopper part 102. A plurality of tab holes (tab fitting grooves) 115 are also formed, in the inner circumference of the one end of the roller 110, like notches in the ring-shaped groove 113. The tab holes 104 of the housing 100 and the tab holes 115 of the roller 110 are provided such that phases thereof in the rotational direction are aligned with each other. Here, four tab holes 104 and four tab holes 115 are provided at 90-degree intervals.

Rotational direction surfaces 104*a* and 115*a*, which extend in a direction perpendicular to a roller rotational direction, are respectively formed on both the end portions of the tab holes 104 and 115 in the roller rotational direction. Further, rotational direction surfaces 130*a*, which extend in the direction perpendicular to the roller rotational direction, are also formed on sections that correspond to both the end portions of the tabs 130 in the roller rotational direction when the tabs 130 are fitted into the tab holes 104 and 115. The rotational direction surfaces 104*a* and 115*a* of the tab holes 104 and 115 can come into contact with the rotational direction surfaces 130*a* of the tabs 130 respectively facing the rotational direction surfaces 104*a* and 115*a*.

The housing 100 and the roller 110 are disposed such that the rotational phases of the tab holes 104 and 115 are aligned with each other, and the tab 130 is disposed in each pair of the four tab holes 104 and 115 whose phases are aligned with each other. Then, adjustment plates (shims) 132 are interposed between the rotational direction surfaces 104*a* and 115*a* of the tab holes 104 and 115, and the rotational direction surfaces 130*a* of the tabs 130, which respectively face the rotational direction surfaces 104*a* and 115*a*. The thickness or quantity of the adjustment plates 132 is selected in accordance with a gap between the rotational direction surfaces 104*a* and 115*a* and the rotational direction surfaces

130*a*. Tab holders 131 are provided as covers and fastened to the housing 100 by bolts (not illustrated).

CITATION LIST

Patent Document

Patent Document 1: Japanese Examined Utility Model Application Publication No. H7-53710

SUMMARY OF INVENTION

Technical Problems

In the above-described grinding roller 10, although the roller 110 is a replacement component that is replaced upon wearing out, it is desirable that durability of the housing 100 be secured. Thus, the housing 100 is designed to be able to secure a predetermined fatigue strength. However, it has been revealed that the designed fatigue strength can sometimes not be obtained for the housing 100.

In light of the foregoing, an object of the present invention is to provide a grinding roller that is capable of ensuring product life by securing a fatigue strength of a roller housing, and a mill provided with the grinding roller.

Solution to Problem

The present inventor has discovered that an area of a housing in the vicinity of a contact section with a tab is likely to be damaged, and because of this, a designed fatigue strength cannot be obtained in some cases. Then, this cause has been examined as follows. Note that the following description will be made with reference to the configuration illustrated in FIGS. 6A, 6B, and 7.

In a coal grinder, the grinding roller 10 grinds coal while rotating. At this time, as a result of biting into the coal, the grinding roller 10 receives a reaction force (a grinding load) from a grinding table provided therebelow and the coal that is being ground, as illustrated in FIGS. 8A and 8B. At this time, as a result of phase changes of the tabs 130, part of the roller housing 100 periodically receives a strong impact of the grinding load through the tabs 130, and a stress concentration occurs.

For example, as illustrated in FIG. 8A, when the tabs 130 are located in positions away from a lower region of the roller 110 that receives the grinding load, the grinding load is mainly transferred onto each peripheral surface (referred to as load transfer areas in the drawings) directly contacting the roller 110 and the roller housing 100. Thus, part of the roller housing 100 is not particularly impacted by the grinding load.

On the other hand, as illustrated in FIG. 8B, when a tab 130 is located in the lower region of the roller 110 that receives the grinding load, between the rotational direction surface 115*a* (see FIG. 7) of the roller main body 110 and the rotational direction surface 130*a* (see FIG. 7) of the tab 130 facing the rotational direction surface 115*a*, and between the rotational direction surface 130*a* of the tab 130 and the rotational direction surface 104*a* (see FIG. 7) of the tab hole 104 of the roller housing 100 facing the rotational direction surface 130*a* (each area is referred to as a load transfer area in the drawing), a large load transfer, which is caused by a clearance (gap) between the two surfaces, occurs in tabs 130 shifted by 90 degrees from the above-described tab 130.

Specifically, although the shims 132 are interposed between the rotational direction surface 115*a* of the roller main body 110 and the rotational direction surface 130*a* of the tab 130 and between the rotational direction surface 130*a* of the tab 130 and the rotational direction surface 104*a* of the roller housing 100, the clearance cannot be eliminated completely. Thus, when the mutually facing rotational direction surfaces 115*a*, 130*a*, and 104*a* receive a force in a direction moving away from or approaching each other, a load resulting from the clearance is applied to the rotational direction surfaces 115*a*, 130*a*, and 104*a*.

Since the direction of the grinding load received by the rotational direction surface 130*a* of the tab 130 through the rotational direction surface 115*a* of the roller main body 110 changes during the rotation of the grinding roller 10, a component of the grinding load received by the mutually facing rotational direction surfaces 115*a*, 130*a*, and 104*a* in the direction moving away from or approaching each other changes cyclically. As illustrated in FIG. 8A, when the rotational direction surfaces 115*a*, 130*a*, and 104*a* are inclined with respect to the direction of the grinding load, the component of the grinding load becomes smaller by the amount of inclination. However, when the inclination becomes smaller, the component of the grinding load received by the rotational direction surfaces 115*a*, 130*a*, and 104*a* becomes larger, and as illustrated in FIG. 8B, when the rotational direction surfaces 115*a*, 130*a*, and 104*a* are oriented so as to perpendicularly face the direction of the grinding load, the component of the received grinding load becomes largest.

Further, the roller 110 is fixed in the axial direction by fastening the pressing plate 120 to the roller housing 100 by bolts 121 and thereby sandwiching the roller 110 between the stopper part 102 of the roller housing 100 and the pressing plate 120. Thus, as illustrated in FIGS. 9A and 9B, a steadily high stress (a steady stress) is generated in a base portion (a root portion) of the stopper part 102.

FIG. 10A is a cross-sectional view of main portions illustrating areas in which the stress is concentrated, in the vicinity of the tab hole 104 into which the tab 130 is fitted, and FIG. 10B is an enlarged view of an area D in FIG. 10A. As illustrated in FIG. 10B, the stress caused by the cyclically changing grinding load is concentrated on a line L1 in a base portion of the rotational direction surface 104*a* of the tab hole 104 of the roller housing 100, and the steady stress caused by the fastening of the pressing plate 120 is concentrated on a line L2 in the base portion of the stopper part 102. As illustrated in FIG. 10B, when the stress concentration line L1 of the base portion of the rotational direction surface 104*a* and the stress concentration line L2 of the base portion of the stopper part 102 intersect each other, a large stress concentration occurs in an area at which the stress concentration lines L1 and L2 intersect each other, as denoted by "X" in FIG. 10B.

FIG. 11 shows a general fatigue curve (a relationship between a stress fluctuation range and the number of repetitions), and fatigue strength tends to decline when the steady stress is superimposed thereon. Specifically, if there is no steady stress, the fatigue strength (the number of repetitions) can be significantly secured by suppressing an upper limit of the stress fluctuation range to some extent. However, if the steady stress is superimposed, the fatigue strength cannot be significantly secured unless the upper limit of the stress fluctuation range is significantly suppressed, and a sufficient fatigue strength cannot be secured in the designed stress fluctuation range (hatched in FIG. 11).

The present invention has been made on the basis of the above-described knowledge.

(1) In order to achieve the above-described object, a grinding roller includes: a roller housing including a roller supporter on an outer circumference thereof, the roller supporter including a fixing stopper part on an outer circumference of one end portion thereof; a roller main body mounted on the roller supporter provided on the outer circumference of the roller housing; a pressing plate fastened to the other end of the roller supporter and configured to fix the roller main body to the roller housing in an axial direction in cooperation with the fixing stopper part; a tab hole formed in both an outer circumference of one end of the roller supporter and an inner circumference of one end of the roller main body; and a tab disposed in each of the tab holes and fixed to the one end of the roller supporter, the tab being configured to fix the roller main body to the roller housing in a rotational direction. A line at which fastening stress caused by the pressing plate is concentrated on a base portion of the fixing stopper part and a line at which stress caused by a grinding load received by the roller main body is concentrated on a base portion of the tab hole are disposed in an offset manner so as not to intersect each other.

(2) It is preferable that the tab hole and the tab include rotational direction surfaces that face each other in a roller rotational direction and are capable of coming into contact with each other, and a base portion of the rotational direction surface of the tab hole of the roller housing be disposed closer to a roller rotation center than a base portion of the fixing stopper part.

(3) It is preferable that the tab hole and the tab include the rotational direction surfaces that face each other in the roller rotational direction and are capable of coming into contact with each other, and a base portion of the rotational direction surface of the tab hole of the roller housing is formed in a curved surface shape to disperse stress.

(4) Another grinding roller of the present invention includes: a roller housing including a roller supporter on an outer circumference thereof, the roller supporter including a fixing stopper part on an outer circumference of one end portion thereof; a roller main body mounted on the roller supporter provided on the outer circumference of the roller housing; a pressing plate fastened to the other end of the roller supporter and configured to fix the roller main body to the roller housing in an axial direction in cooperation with the fixing stopper part; a tab hole formed on one end of the roller main body; and a tab portion formed in the roller housing and disposed in the tab hole, the tab portion being configured to fix the roller main body to the roller housing in a rotational direction. A line at which fastening stress caused by the pressing plate is concentrated on a base portion of the fixing stopper part and a line at which stress caused by a grinding load received by the roller main body is concentrated on a base portion of the tab portion of the roller housing are disposed in an offset manner so as not to intersect each other.

(5) It is preferable that the tab hole and the tab portion include rotational direction surfaces that face each other in a roller rotational direction and are capable of coming into contact with each other, the tab portion of the roller housing be provided protruding outward in a radial direction beyond the fixing stopper part, and a base portion of the rotational direction surface of the tab portion be formed in a curved surface shape to disperse stress.

(6) A mill of the present invention includes: a housing formed in a hollow shape; a grinding table supported by a support shaft extending along a vertical direction in the housing to be capable of being driven to rotate; and a grinding roller according to any one of the above-described (1) to (5). The grinding roller is disposed above the grinding table and rotatably supported by a support shaft, and is capable of rotating together with the grinding table as a result of an outer circumferential surface of the grinding roller coming into contact with the top surface of the grinding table.

Advantageous Effects of Invention

Since the grinding roller of the present invention has a configuration in which (fluctuating) stress caused by a grinding load and (steady) fastening stress caused by a pressing plate are not superimposed, fatigue strength is improved, thereby allowing product life to be improved.

BRIEF DESCRIPTION OF DRAWINGS

FIGS. 1A and 1B are diagrams both illustrating main portions of a grinding roller according to a first embodiment, where FIG. 1A is a cross-sectional view of the main portions, and FIG. 1B is an enlarged view of an area A1 of FIG. 1A.

FIG. 2 is a cross-sectional view illustrating main portions of a coal grinder provided with a grinding roller according to each embodiment.

FIG. 3A is a cross-sectional view of the main portions, and FIG. 3B is an enlarged view of an area A2 of FIG. 3A.

FIG. 4A is a cross-sectional view of the main portions, and FIG. 4B is an enlarged view of an area B1 of FIG. 4A.

FIG. 5A is a cross-sectional view of the main portions, and FIG. 5B is an enlarged view of an area B2 of FIG. 5A.

FIGS. 6A and 6B are diagrams both illustrating the grinding roller according to the background art, where FIG. 6A is a perspective view of the grinding roller, and FIG. 6B is a vertical cross-sectional view of the grinding roller.

FIG. 7 is an exploded perspective view illustrating the grinding roller according to the background art.

FIG. 8A illustrates a case in which an impact of a grinding load is small, and FIG. 8B illustrates a case in which the impact of the grinding load is large.

FIG. 9A is a schematic vertical cross-sectional view of the grinding roller, and FIG. 9B is an enlarged view of an area C of FIG. 9A.

FIGS. 10A and 10B are diagrams both illustrating main portions of the grinding roller for illustrating the analysis of the problem the present invention intends to solve, where FIG. 10A is a cross-sectional view of the main portions, and FIG. 10B is an enlarged view of an area D of FIG. 10A.

FIG. 11 is a diagram illustrating the analysis of the problem the present invention intends to solve and shows a general fatigue curve (a relationship between a stress fluctuation range and the number of repetitions).

DESCRIPTION OF EMBODIMENTS

Figure 3A:
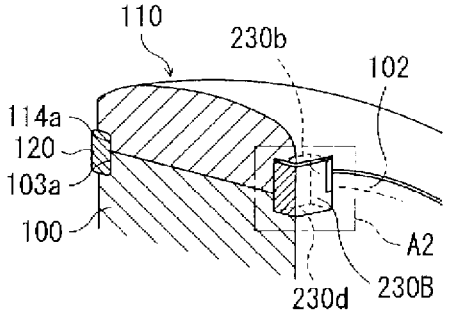
FIGS. 3A and 3B are diagrams both illustrating main portions of a grinding roller according to a second embodiment, where

Embodiments of the present invention will be described below with reference to the drawings.

Note that in the present embodiment, although a case will be described in which a grinding roller according to the present invention is applied to a coal grinder that grinds and pulverizes coal, this grinding roller can be widely applied to mills that grind and pulverize a solid matter, which is not limited to the coal.

First Embodiment

Configuration of Coal Grinder

First, with reference to FIG. 2, a configuration of a coal grinder according to a present embodiment will be described. As illustrated in FIG. 2, the coal grinder, which is also called a vertical mill, includes a vertical hollow cylindrical housing 11, and a coal feeding tube 14. The coal feeding tube 14, through which coal, a raw material to be ground, is fed, is disposed along the central axis of a ceiling portion 11*a* of the housing 11. A grinding table 13, on which the coal fed from the coal feeding tube 14 is ground, is disposed on a base 12 located directly below the coal feeding tube 14. The grinding table 13 is driven by a drive device (not illustrated) to rotate around an axial center extending in the vertical direction along the central axis. In FIG. 2, outlined arrows pointing downward indicate a feeding direction of the coal.

A grinding surface 13*a*, which has an annular shape concentric with the central axis, is formed on the upper surface of the grinding table 13, and above the grinding surface 13*a*, a plurality (three, for example) of grinding rollers 10 are disposed facing the grinding table 13*a* at even intervals in the circumferential direction. Each of the grinding rollers 10 is rotatably supported, via a bearing (not illustrated), at a leading end portion of a support shaft 16 that is disposed tilted downward from a peripheral wall 11*b* of the housing 11 toward a center portion of the housing 11.

Note that a pin 18, which extends in the tangential direction of the outer circumference of the grinding table 13, is provided in a holder 17 that supports the support shaft 16. The holder 17, the support shaft 16, and the grinding roller 10 are supported, by the peripheral wall 11*b* via the pin 18, swingable in a direction approaching the grinding surface 13*a* and in a direction moving away from the grinding surface 13*a*.

A protrusion 17*a*, which is provided protruding downwardly, is formed on the holder 17, and a stopper 19 is installed in the peripheral wall 11*b*. When the leading end of the stopper 19 comes into contact with the protrusion 17*a*, an approach of the grinding roller 10 toward the grinding surface 13*a* is regulated. The position of the leading end of the stopper 19 is adjusted as a result of the stopper 19 being driven to advance and retract by an actuator 20.

Further, an urging device 21 is installed that applies, to the grinding roller 10, a load for grinding the coal. The urging device 21 includes a hydraulic cylinder 22 fixed to the peripheral wall 11*b* and a plunger 23 driven in the axial direction thereof by the hydraulic cylinder 22. An arm 17*b* extends on an upper portion of the holder 17, and as a result of the leading end of the plunger 23 being pushed against the arm 17*b*, a downward load (directed toward the grinding surface 13*a*), which grinds the coal on the grinding surface 13*a*, is applied to the grinding roller 10.

An inlet port 24, through which primary air is supplied, is provided in a lower portion of the housing 11 which is in the vicinity of the outer circumference of the grinding table 13. Air, which has been compressed by a primary blower (not illustrated), is supplied through the inlet port 24 into the housing 11 as the primary air, which results in a high pressure atmosphere inside the housing 11.

A rotary separator (a classifier) 26, which classifies ground solid matter (hereinafter, referred to as "ground matter") using a classifying blade 25, is provided in an upper portion of the housing 11 which is in the vicinity of the outer circumference of the coal feeding tube 14. Further, an outlet port 27, through which the classified ground matter is discharged, is provided in the ceiling portion 11*a* of the housing 11. Furthermore, a foreign substance discharge tube 28 is provided in a lower portion of the housing 11. The foreign substance discharge tube 28 causes foreign substances (spillage) mixed in the solid matter, such as stones or metal pieces, to fall from an outer circumferential portion of the grinding table 13 and be discharged.

The solid matter, which has been ground by the grinding rollers 10, becomes ground matter, and as a result of driving the primary blower, the ground matter is lifted while being dried by the primary air supplied into the housing 11 through the inlet port 24. The lifted ground matter is classified by the rotary separator 26 into: coarse powder which falls and returns back onto the grinding table 13, and is then reground; and fine powder which passes through the rotary separator 26 and is discharged through the outlet port 27 with the help of the airflow. Further, such spillage mixed in the solid matter as stones or metal pieces falls from the outer circumferential portion of the grinding table 13 by centrifugal force, and is discharged through the foreign substance discharge tube 28.

Configuration of Grinding Roller

A schematic configuration of the grinding roller 10 installed in such a coal grinder is substantially the same as that of the background art illustrated in FIGS. 6A, 6B, and 7. Thus, the schematic configuration of the grinding roller 10 will be described with reference to FIGS. 6A, 6B, and 7, although their descriptions overlap with each other.

However, since the tab holes (tab fitting grooves) 104 and the tabs 130 of the roller housing 100 are different from those of the background art, the description will be made below with the reference sign 204A used for the tab holes of the housing 100, the reference sign 204*a* used for the rotational direction surfaces of the tab holes 204A, the reference sign 230A used for the tabs, and the reference sign 230*a* used for the rotational direction surfaces of the tabs 230A.

As illustrated in FIGS. 6A, 6B and 7, the grinding roller 10 includes the roller housing (hereinafter, also simply referred to as "housing") 100 and a roller main body (hereinafter, also simply referred to as "roller") 110 that is externally fitted onto the housing 100 in the detachable manner. The roller 110 is subject to wear during operation. Thus, the configuration is employed in which the roller 110 is fixed by being fitted onto the housing 100 and only the roller 110 is replaced in accordance with the wear amount.

The housing 100 is formed in a tubular shape, and a roller supporter (hereinafter, also simply referred to as "supporter") 101, which has an enlarged diameter, is formed on the outer circumference of the housing 100. The support shaft 16 is fitted into the inner circumference of the housing 100, and the roller 110 is fitted onto the outer circumference of the supporter 101 of the housing 100. The roller 110 is formed in the annular shape, and has the holder portion 111 fixed to the housing 100 on the inner circumferential side thereof. The grinding pressure contact portion 112, which is pressed against and grinds the coal that is the object to be ground, is fixedly provided on the outer circumference of the holder portion 111.

The roller 110 is fixed as a result of the holder portion 111 being externally fitted onto the housing 100. Here, the roller 110 is fixed in the rotational direction as well as in the axial direction. The roller 110 is sandwiched, from both ends in the axial direction thereof, between a flange-shaped fixing stopper part (hereinafter, also simply referred to as "stopper part") 102 formed in the housing 100 and a pressing plate 120 joined to the housing 100, which causes the roller 110 to be fixed in the axial direction. The tabs 230A (see FIGS. 1A and 1B) are fixed into the tab holes 204A and 115 formed in both the housing 100 and the roller 110, which causes the roller 110 to be fixed in the rotational direction.

The fixing in the axial direction will now be explained. The stopper part 102 is formed protruding on the outer circumference of one end of the supporter 101 of the housing 100, and a ring-shaped groove 113, which fits with the stopper part 102, is formed on the inner circumference of one end of the roller 110. Further, a ring-shaped groove 103, on which the pressing plate 120 is mounted, is formed on the outer circumference of the other end of the supporter 101 of the housing 100, and a ring-shaped groove 114, which fits with the pressing plate 120, is formed on the inner circumference of the other end of the roller 110.

Pressure contact surfaces 102*a* and 113*a*, which face and press against each other, are respectively formed on the stopper part 102 of the housing 100 and the ring-shaped groove 113 of the roller 110, and pressure contact surfaces 103*a* and 114*a*, which face and press against the pressing plate 120, are respectively formed on the ring-shaped groove 103 of the housing 100 and the ring-shaped groove 114 of the roller 110.

The pressing plate 120 is a plate member formed in an annular shape. The pressing plate 120 is mounted onto the ring-shaped groove 103 provided on the other end of the housing 100 and onto the ring-shaped groove 114 provided on the other end of the roller 110, and is fastened to the housing 100 by multiple bolts 121 with the roller 110 fitted on the outer circumference of the supporter 101 of the housing 100.

As a result of this fastening, a pressure contact surface 120*a* of the pressing plate 120, which faces the pressure contact surface 103*a* of the housing 100 and the pressure contact surface 114*a* of the roller 110, is pressed against the pressure contact surface 103*a* of the housing 100, and at the same time, is pressed with a greater pressing force against the pressure contact surface 114*a* of the roller 110. Additionally, as a result of this fastening, the pressure contact surface 102*a* of the stopper part 102 of the housing 100 is pressed against the pressure contact surface 113*a* of the ring-shaped groove 113 of the roller 110.

The fixing in the rotational direction will now be explained. The plurality of tab holes (tab fitting grooves) 204A (see FIG. 1B) are formed, in the outer circumference of the one end of the supporter 101 of the housing 100, like notches in the stopper part 102. The plurality of tab holes (tab fitting grooves) 115 are also formed, in the inner circumference of the one end of the roller 110, like notches in the ring-shaped groove 113. The tab holes 204A of the housing 100 and the tab holes 115 of the roller 110 are provided such that phases thereof in the rotational direction are aligned with each other. Here, four tab holes 204A and four tab holes 115 are provided at 90-degree intervals.

The rotational direction surfaces 204*a* and 115*a*, which are oriented in the roller rotational direction, are respectively formed on both the end portions of the tab holes 204A and 115 in the roller rotational direction. Further, the rotational direction surfaces 230*a*, which are oriented in the roller rotational direction, are also formed on sections that correspond to both the end portions of the tabs 230A in the roller rotational direction when the tabs 230A are fitted into the tab holes 204A and 115. The rotational direction surfaces 204*a* and 115*a* of the tab holes 204A and 115 can come into contact with the rotational direction surfaces 230*a* of the tabs 230A respectively facing the rotational direction surfaces 204*a* and 115*a*.

The housing 100 and roller 110 are disposed such that the rotational phases of the tab holes 204A and 115 are aligned with each other, and the tab 230A is disposed in each pair of the four tab holes 204A and 115 whose phases are aligned with each other. Then, adjustment plates (shims) 132 are interposed between the rotational direction surfaces 204*a* and 115*a* of the tab holes 204A and 115, and the rotational direction surfaces 230*a* of the tabs 230A, which respectively face the rotational direction surfaces 204*a* and 115*a*. The thickness or quantity of the adjustment plates 132 is selected in accordance with a gap between the rotational direction surfaces 204*a* and 115*a* and the rotational direction surfaces 230*a*. Tab holders 131 are provided as covers and fastened to the housing 100 by bolts (not illustrated).

Configuration of Tabs and Tab Holes

As illustrated in FIGS. 1A and 1B, the grinding roller 10 of the present embodiment is characterized by the shape and size of the tab hole 204A of the housing 100 and the shape of the tab 230A. Note that FIGS. 1A and 1B are cross-sectional views illustrating half portions of the tab holes 204A and 115 of the housing 100 and the roller 110 obtained by cutting the tab holes 204A and 115 at the center in the circumferential direction thereof (the center in the rotational direction), and the other half portions of the tab holes 204A and 115 are formed in a symmetrical shape to those of the above-described half portions. Further, FIG. 1A illustrates a state in which the tab 230A and the shim 132 are mounted, and FIG. 1B illustrates a state in which the tab 230A and the shim 132 are removed.

As illustrated in FIG. 1A, the tab hole 204A of the housing 100 is formed like a notch in a part of the stopper part 102 and extends toward the rotation center of the roller beyond a base portion (a root portion) of the stopper part 102. Thus, a base portion (a section located on the roller rotation center side) of the rotational direction surface 204*a* of the tab hole 204A is disposed in a position shifted closer to the roller rotation center side than the base portion of the stopper part 102.

Note that the rotational direction surface 204*a* of the tab hole 204A and a surface (a bottom surface) 204*c* of the tab hole 204A on the roller rotation center side thereof are connected to each other by a smoothly and continuously curved surface 205, and the base portion of the rotational direction surface 204*a* of the tab hole 204A is positioned on this curved surface 205. Note that, in order to facilitate the identification of the curved surface 205, the curved surface 205 is hatched in FIG. 1B.

Further, the tab 230A is also formed larger in the radial direction in accordance with the shape of the tab hole 204A, and the rotational direction surface 230*a* of the tab 230A, which faces the rotational direction surface 204*a* of the tab hole 204A, and a bottom surface 230*c* of the tab 230A, which faces the bottom surface 204*c* of the tab hole 204A, are also formed in accordance with the shape of the tab hole 204A. Note that the tab hole 115 of the roller 110 is not particularly changed.

A line L2, at which the fastening stress caused by the pressing plate 120 is concentrated on a base portion of the stopper part 102, and a line L1, at which the stress caused by the grinding load received by the roller main body 110 is concentrated on the base portion of the tab hole 204A of the roller housing 100, are disposed in an offset manner so as not to intersect each other, thus allowing the stress concentration to be alleviated.

Further, compared with a case in which the base portion of the rotational direction surface 204*a* of the tab hole 204A is disposed in the same position in the radial direction as the base portion of the stopper part 102, the rotational direction surface 204*a* of the tab hole 204A and the rotational direction surface 230*a* of the tab 230A are expanded. The expansion of the contact area causes a force transferred in the rotational direction on the rotational direction surfaces 204*a* and 230*a* to be dispersed. Also in this respect, the stress concentration is caused to be alleviated.

Further, if an interface section between the rotational direction surface 204*a* of the tab hole 204A and the bottom surface 204*c* of the tab hole 204A is not smooth, the stress concentration easily occurs in this section (the base portion of the rotational direction surface 204*a*). However, the interface section between the rotational direction surface 204*a* and the bottom surface 204*c* is connected by the smoothly curved surface 205. Also in this respect, the stress concentration is caused to be alleviated.

Actions and Effects

Since the grinding roller 10 according to the present embodiment is configured in the above-described manner, the stress concentration is alleviated in the base portion of the rotational direction surface 204*a* of the tab hole 204A of the roller housing 100 and the like. As a result, the fatigue strength can be improved, and product life can thus be improved.

Specifically, since the line L2, at which the fastening stress caused by the pressing plate 120 is concentrated on the base portion of the stopper part 102, and the line L1, at which the stress caused by the grinding load received by the roller main body 110 is concentrated on the base portion of the tab hole 204A of the roller housing 100, are disposed in the offset manner, the stress concentration is alleviated.

Further, since the rotational direction surface 204*a* of the tab hole 204A is expanded, and the force transferred in the rotational direction on the rotational direction surfaces 204*a* and 230*a* is thereby dispersed, the stress concentration is alleviated.

Furthermore, since the interface section between the rotational direction surface 204*a* of the tab hole 204A and the bottom surface 204*c* of the tab hole 204A is connected by the smoothly curved surface 205, the stress concentration is alleviated.

Second Embodiment

Configuration of Tabs and Tab Holes

The present embodiment is obtained by partially changing the first embodiment. Such changes made to the first embodiment will be described with reference to FIGS. 3A and 3B. Note that in FIGS. 3A and 3B, the same reference signs as those in FIGS. 1A and 1B refer to the same components, and descriptions thereof will be omitted or simplified.

Figure 3B:
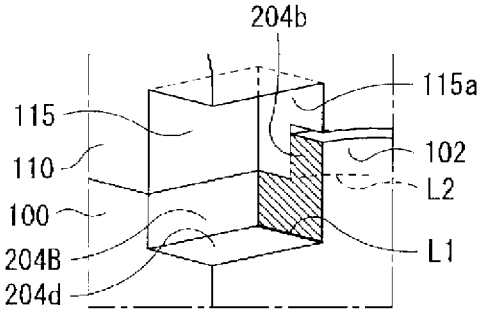

As illustrated in FIGS. 3A and 3B, in a grinding roller 10 of the present embodiment, the shape and size of a tab hole 204B of the housing 100 and the shape of a tab 230B are partially different from those of the first embodiment.

Specifically, as illustrated in FIGS. 3A and 3B, in the present embodiment, the tab hole 204B of the housing 100 is formed extending toward the roller rotation center beyond the base portion (the root portion) of the stopper part 102, in the same manner as in the first embodiment. However, a rotational direction surface 204*b* of the tab hole 204B and a surface (a bottom surface) 204*d* of the tab hole 204B on the roller rotation center side are connected to each other in a discontinuous and bent manner. A rotational direction surface 230*b* and a bottom surface 230*d* of the tab 230B are also formed in a shape corresponding to the rotational direction surface 204*b* and the bottom surface 204*d* of the tab hole 204B, respectively. Note that, in order to facilitate the identification of the rotational direction surface 204*b*, the rotational direction surface 204*b* is hatched in FIG. 3B.

Actions and Effects

Since the grinding roller 10 according to the present embodiment is configured in the above-described manner, the line L2, at which the fastening stress caused by the pressing plate 120 is concentrated on the base portion of the stopper part 102, and the line L1, at which the stress caused by the grinding load received by the roller main body 110 is concentrated on the base portion of the tab hole 204B of the roller housing 100, are disposed in an offset manner, and the stress concentration is thus alleviated. In addition, due to alleviation of the stress concentration achieved as a result of expanding the rotational direction surface 204*b* of the tab hole 204B, the fatigue strength is improved, and the product life can thus be improved.

Third Embodiment

Configuration of Tab Portion

Figure 4A:
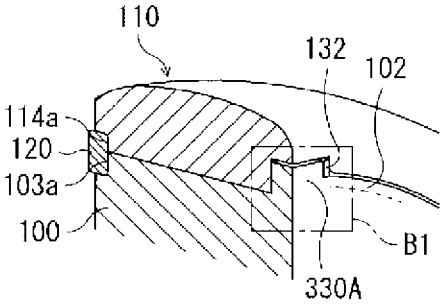
FIGS. 4A and 4B are diagrams both illustrating main portions of a grinding roller according to a third embodiment, where
Figure 4B:
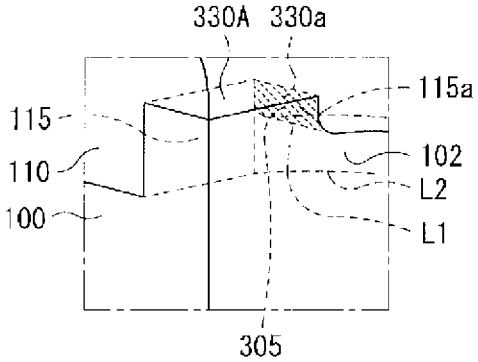

In the present embodiment, as illustrated in FIGS. 4A and 4B, a tab portion 330A is integrally formed with the roller housing 100. However, the present embodiment shares the same technical idea as the first and second embodiments in terms of alleviating the stress concentration in the roller housing 100. Note that in FIGS. 4A and 4B, the same reference signs as those in FIGS. 1A and 1B refer to the same components, and descriptions thereof will be omitted or simplified.

As illustrated in FIGS. 4A and 4B, the tab portion 330A is formed in the roller housing 100, protruding outward in the radial direction beyond the stopper part 102. This tab portion 330A is formed in an area corresponding to the areas in which the tab holes 204A and 204B are formed in the first and second embodiments. The tab hole 115, into which the tab portion 330A is inserted, is formed in the roller 110.

A rotational direction surface 330*a*, which is oriented in the roller rotational direction, is formed on the tab portion 330A, and the rotational direction surface 115*a*, which faces the rotational direction surface 330*a*, is formed on the tab hole 115 of the roller 110.

Further, a base portion of the rotational direction surface 330*a* of the tab portion 330A, namely, an edge portion of the rotational direction surface 330*a* on the roller rotation center side is shifted outward in the radial direction further than the base portion (the root portion) of the stopper part 102.

Therefore, the line L2, at which the fastening stress caused by the pressing plate 120 is concentrated on the base portion of the stopper part 102 of the roller housing 100, and the line L1, at which the stress caused by the grinding load received by the roller main body 110 is concentrated on the base portion of the tab portion 330A of the roller housing 100, are disposed in an offset manner so as not to intersect each other, and the stress concentration is thus alleviated.

Further, the rotational direction surface 330*a* of the tab portion 330A and the outer circumferential surface of the stopper part 102 are connected to each other by a smoothly and continuously curved surface 305. The base portion of the rotational direction surface 330*a* of the tab portion 330A is positioned on this curved surface 305, and the stress concentration is alleviated by this curved surface 305 also. Note that, in order to facilitate the identification of the curved surface 305, the curved surface 305 is hatched in FIG. 4B.

Actions and Effects

Since the grinding roller 10 according to the present embodiment is configured in the above-described manner, the line L2, at which the fastening stress caused by the pressing plate 120 is concentrated on the base portion of the stopper part 102, and the line L1, at which the stress caused by the grinding load received by the roller main body 110 is concentrated on the base portion of the tab portion 330A of the roller housing 100, are disposed in an offset manner, and the stress concentration is thus alleviated. In addition, due to alleviation of the stress concentration achieved as a result of the rotational direction surface 330*a* of the tab portion 330A and the outer circumferential surface of the stopper part 102 being connected to each other by the curved surface 305, the fatigue strength is improved, and the product life can thus be improved.

Fourth Embodiment

Configuration of Tab Portion

The present embodiment is obtained by partially changing the third embodiment. Such changes made to the third embodiment will be described with reference to FIGS. 5A and 5B. Note that in FIGS. 5A and 5B, the same reference signs as those in FIGS. 4A and 4B refer to the same components, and descriptions thereof will be omitted or simplified.

Figure 5A:
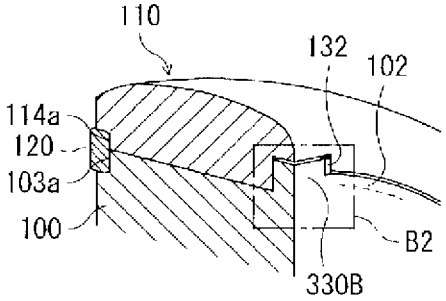
FIGS. 5A and 5B are diagrams both illustrating main portions of a grinding roller according to a fourth embodiment, where
Figure 5B:
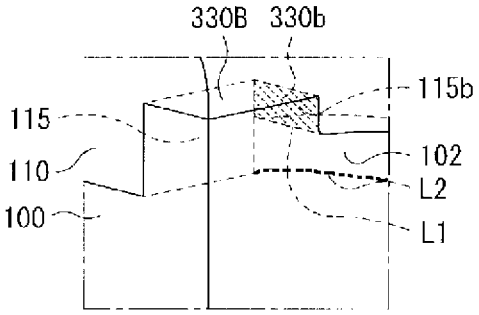
Figure 8A:
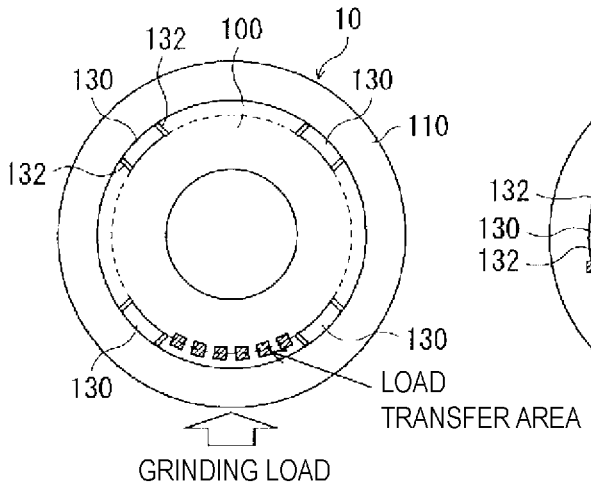
FIGS. 8A and 8B are diagrams both illustrating an analysis of the problem the present invention intends to solve, where
Figure 8B:
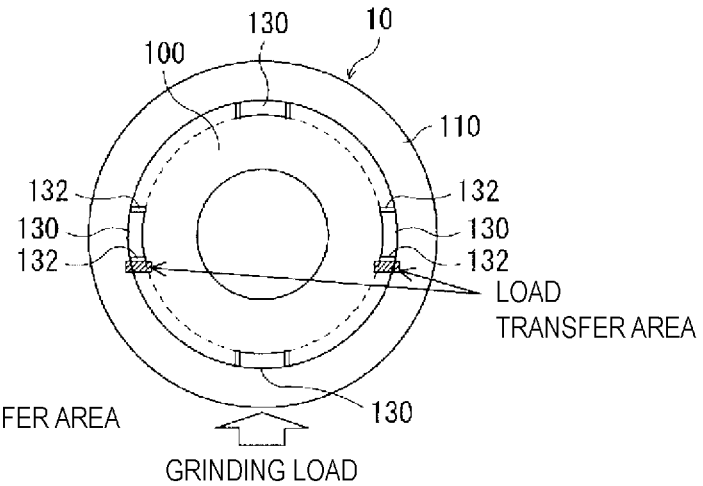
Figure 9A:
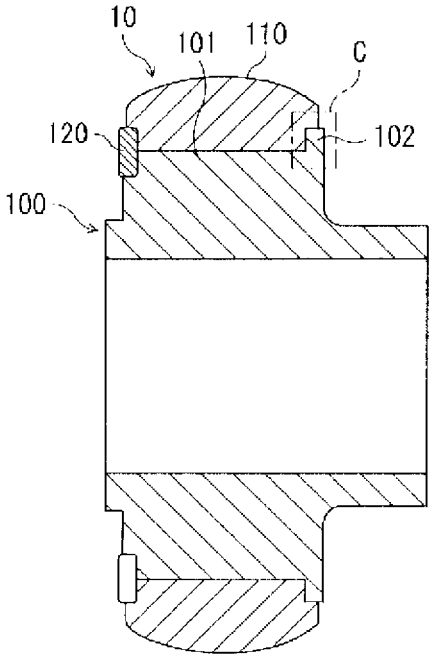
FIGS. 9A and 9B are diagrams both illustrating an analysis of the problem the present invention intends to solve, where
Figure 9B:
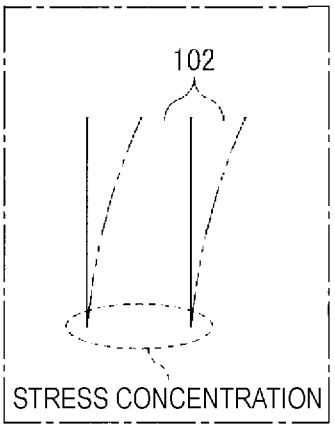

As illustrated in FIGS. 5A and 5B, in a grinding roller 10 of the present embodiment, the shape of a tab portion 330B of the housing 100 is partially different from that of the third embodiment.

Specifically, in the present embodiment, a rotational direction surface 330*b* of the tab portion 330B and the outer circumferential surface of the stopper part 102 are connected to each other in a discontinuous and bent manner. Except for this point, the grinding roller 10 of the present embodiment is configured in the same manner as that of the third embodiment. Note that, in order to facilitate the identification of the rotational direction surface 330*b*, the rotational direction surface 330*b* is hatched in FIG. 5B.

Actions and Effects

Since the grinding roller 10 according to the present embodiment is configured in the above-described manner, the line L2, at which the fastening stress caused by the pressing plate 120 is concentrated on the base portion of the stopper part 102, and the line L1, at which the stress caused by the grinding load received by the roller main body 110 is concentrated on the base portion of the tab portion 330B of the roller housing 100, are disposed in an offset manner, and the stress concentration is thus alleviated. As a result, the fatigue strength is improved, and the product life can thus be improved.

Other

Although the embodiments of the present invention have been described above, the present invention is not limited to those embodiments. The above-described embodiments may be modified as necessary and implemented without departing from the gist of the present invention.

For example, even though no mention has been made in the above-described embodiments, a fluctuating stress range is narrowed by an increase in the area that receives the grinding load in the first and second embodiments. Besides, an increase in the thickness of the stopper part as a measure to reduce the steady stress reduces both the fluctuating stress range and the steady stress.

REFERENCE SIGNS LIST

10 Grinding roller
11 Housing
13 Grinding table
13*a* Grinding surface
14 Coal feeding tube
16 Support shaft
17 Holder
18 Pin
19 Stopper
20 Actuator
21 Urging device
22 Hydraulic cylinder
23 Plunger
24 Inlet port
25 Classifying blade
26 Rotary separator (classifier)
27 Outlet port
28 Foreign substance discharge tube
100 Roller housing (housing)
101 Roller supporter (supporter)
102 Fixing stopper part (stopper part)
103 Ring-shaped groove
102*a*, 103*a* Pressure contact surface
110 Roller main body (roller)
111 Holder portion
112 Grinding pressure contact portion
113, 114 Ring-shaped groove
113*a*, 114*a* Pressure contact surface
115, 204A Tab hole (tab fitting groove)
115*a*, 204*a* Rotational direction surface
120 Pressing plate
120*a* Pressure contact surface
121 Bolt
131 Tab holder
132 Adjustment plate (shim)
204A, 204B Tab hole
204*a*, 204*b* Rotational direction surface
204*c*, 204*d* Bottom surface
205, 305 Curved surface
230A, 230B Tab
230*a*, 230*b* Rotational direction surface
230*c*, 230*d* Bottom surface
330A, 330B Tab portion
330*a*, 330*b* Rotational direction surface

The invention claimed is:

1. A grinding roller comprising:

a roller housing including a roller supporter on an outer circumference surface thereof, the roller supporter including a fixing stopper part on an outer circumference surface of one end side thereof;

a roller main body mounted on the roller supporter provided on the outer circumference surface of the roller housing;

a tab hole formed in both the outer circumference surface of the one end side of the roller supporter and an inner circumference surface of one end side of the roller main body, the tab hole formed in the outer circumference surface of the one end side of the roller supporter being formed into a notch in the fixing stopper part;

a tab disposed in both of the tab holes and fixed to the one end side of the roller supporter, the tab being configured to fix the roller main body to the roller housing in a rotational direction; and a pressing plate fastened to an other end side of the roller supporter and configured to fix the roller main body to the roller housing in an axial direction in cooperation with the fixing stopper part, wherein the fixing stopper part is formed in a flange shape, the tab hole and the tab include rotational direction surfaces that face each other in a roller rotational direction and are capable of coming into contact with each other, and a first line on which fastening stress caused by the pressing plate is concentrated on a base portion of the fixing stopper part and a second line on which stress caused by a grinding load received by the roller main body is concentrated on a base portion of the rotational direction surface of the tab hole of the roller housing are disposed in an offset manner so as not to intersect each other, wherein the first line is a line existing at an interface section between the rotation direction surface of the tab hole and a bottom surface of the tab hole, the bottom surface being a surface on a roller rotation center side of the tab hole, and wherein the second line is a ring-shaped line at a base of a pressure contact surface of the fixing stopper part protruding on the outer circumference of the one end side of the roller supporter of the housing.

2. The grinding roller according to claim 1, wherein the base portion of the rotational direction surface of the tab hole of the roller housing is disposed closer to a roller rotation center than the base portion of the fixing stopper part.

3. The grinding roller according to claim 1, wherein the base portion of the rotational direction surface of the tab hole of the roller housing is formed in a curved surface shape to disperse stress.

4. The grinding roller according to claim 2, wherein the base portion of the rotational direction surface of the tab hole of the roller housing is formed in a curved surface shape to disperse stress.

5. A grinding roller comprising:

a roller housing including a roller supporter on an outer circumference surface thereof, the roller supporter including a fixing stopper part on an outer circumference surface of one end side thereof;

a roller main body mounted on the roller supporter provided on the outer circumference surface of the roller housing;

a pressing plate fastened to an other end side of the roller supporter and configured to fix the roller main body to the roller housing in an axial direction in cooperation with the fixing stopper part;

a tab hole formed on one end side of the roller main body;

a tab portion formed in the roller housing, protruding outward in a radial direction beyond the fixing stopper part and disposed in the tab hole, the tab portion being configured to fix the roller main body to the roller housing in a rotational direction, wherein the fixing stopper part is formed in a flange shape, the tab hole and the tab portion include rotational direction surfaces that face each other in a roller rotational direction and are capable of coming into contact with each other, a first line on which fastening stress caused by the pressing plate is concentrated on a base portion of the fixing stopper part and a second line on which stress caused by a grinding load received by the roller main body is concentrated on a base portion of the rotational direction surface of the tab portion of the roller housing are disposed in an offset manner so as not to intersect each other, wherein the first line is a line formed by an intersection of the rotation direction surface of the tab portion and an outer peripheral surface of the fixing stopper part, and wherein the second line is a ring-shaped line at a base of a pressure contact surface of the fixing stopper part protruding on the outer circumference of the one end side of the roller supporter of the housing.

6. The grinding roller according to claim 5, wherein the tab hole and the tab portion include rotational direction surfaces that face each other in a roller rotational direction and are capable of coming into contact with each other, and the base portion of the rotational direction surface of the tab portion is formed in a curved surface shape to disperse stress.

7. A mill comprising:

a housing formed in a hollow shape;

a grinding table supported by a support shaft extending along a vertical direction in the housing to be capable of being driven to rotate; and a grinding roller according to claim 1 disposed above the grinding table and rotatably supported by a support shaft, the grinding roller being capable of rotating together with the grinding table as a result of an outer circumferential surface of the grinding roller coming into contact with a top surface of the grinding table.

8. A mill comprising:

a housing formed in a hollow shape;

a grinding table supported by a support shaft extending along a vertical direction in the housing to be capable of being driven to rotate; and a grinding roller according to claim 2 disposed above the grinding table and rotatably supported by a support shaft, the grinding roller being capable of rotating together with the grinding table as a result of an outer circumferential surface of the grinding roller coming into contact with a top surface of the grinding table.

9. A mill comprising:

a housing formed in a hollow shape;

a grinding table supported by a support shaft extending along a vertical direction in the housing to be capable of being driven to rotate; and a grinding roller according to claim 3 disposed above the grinding table and rotatably supported by a support shaft, the grinding roller being capable of rotating together with the grinding table as a result of an outer circumferential surface of the grinding roller coming into contact with a top surface of the grinding table.

10. A mill comprising:

a housing formed in a hollow shape;

a grinding table supported by a support shaft extending along a vertical direction in the housing to be capable of being driven to rotate; and a grinding roller according to claim 4 disposed above the grinding table and rotatably supported by a support shaft, the grinding roller being capable of rotating together with the grinding table as a result of an outer circumferential surface of the grinding roller coming into contact with a top surface of the grinding table.

11. A mill comprising:

a housing formed in a hollow shape;

a grinding table supported by a support shaft extending along a vertical direction in the housing to be capable of being driven to rotate; and a grinding roller according to claim 5 disposed above the grinding table and rotatably supported by a support shaft, the grinding roller being capable of rotating together with the grinding table as a result of an outer circumferential surface of the grinding roller coming into contact with a top surface of the grinding table.

12. A mill comprising:

a housing formed in a hollow shape;

a grinding table supported by a support shaft extending along a vertical direction in the housing to be capable of being driven to rotate; and a grinding roller according to claim 6 disposed above the grinding table and rotatably supported by a support shaft, the grinding roller being capable of rotating together with the grinding table as a result of an outer circumferential surface of the grinding roller coming into contact with a top surface of the grinding table.

* * * * *